United States Patent [19]

Sunas

[11] Patent Number: 4,827,949

[45] Date of Patent: May 9, 1989

[54] METHOD OF TREATING TOBACCO AND TOBACCO PRODUCED THEREBY

[76] Inventor: Ernest C. Sunas, 5411 Russel Rd., Durham, N.C. 27712

[21] Appl. No.: 97,529

[22] Filed: Sep. 16, 1987

[51] Int. Cl.[4] ..... A24B 15/30

[52] U.S. Cl. ..... 131/310; 131/275

[58] Field of Search ..... 131/309, 310, 302, 303, 131/304, 305, 352, 275; 426/632

[56] References Cited

U.S. PATENT DOCUMENTS

| | | | |
|---|---|---|---|
| 1,008,730 | 11/1911 | Rodenhausen | 131/310 |
| 1,407,274 | 2/1922 | Hibbert | 131/352 |
| 2,460,284 | 2/1949 | Hale | 131/352 |
| 4,528,993 | 7/1985 | Sensabaugh et al. | 131/310 |
| 4,647,463 | 3/1987 | Hoover | 426/632 |

FOREIGN PATENT DOCUMENTS

| | | | |
|---|---|---|---|
| 1813620 | 8/1970 | Fed. Rep. of Germany | 131/305 |

OTHER PUBLICATIONS

"Tobacco Quality: 3—Sugar's Role in Processing", From *Tobacco Technology:* Date 4/1968: Pages Cited 13–15, Article Written by Abdallah.

*Primary Examiner*—V. Millin
*Attorney, Agent, or Firm*—Steven J. Hultquist

[57] ABSTRACT

A method of treating tobacco by contact with a monosaccharide is disclosed. Preferably, the monosaccharide is provided in an aqueous casing solution which is sprayed on a steamed tobacco. After the cased tobacco has been heat treated in a toaster it is ready for processing. It is preferred that the aqueous casing solution be basic and include a latent amino acid source. Unaged tobacco treated by the method of the present invention exhibits smoke and taste characteristics similar to naturally-aged, cured tobacco.

42 Claims, 5 Drawing Sheets

GAS CHROMATOGRAM OF "QUICK AGED" BF1XX BURLEY TOBACCO, RELATIVE AREA VERSUS TIME, MINUTES

GAS CHROMATOGRAM OF SMOKE OF NATURALLY AGED BF1XX BURLEY TOBACCO, RELATIVE AREA VERSUS TIME, MINUTES

METHOD OF TREATING TOBACCO AND TOBACCO PRODUCED THEREBY

BACKGROUND OF THE INVENTION

1. Field of the Invention

The present invention relates generally to a method for treating tobacco and to the tobacco produced by the method. In particular, the method is concerned with rapidly converting a cured tobacco into a tobacco having smoke, flavor and taste characteristics of a naturally-aged, cured tobacco.

2. Description of the Related Art

It is well known that freshly harvested tobacco generally requires several years of processing before is provides a pleasant smoke to a smoker. Typically, harvested tobacco is dried for several months in order to cure it. The cured tobacco undergoes several sweating or aging operations over a period of two to three years. During curing and aging, chemical changes in the tobacco increase the flavor and other desirable constituents and decrease harsh and less desirable constituents.

Conventional curing and aging has substantial economic drawbacks. First, the tobacco must be stored for a substantial period and cannot be processed into tobacco products until the curing and aging is complete. Second, storage and maintenance costs are substantial. Various equipment must be utilized to monitor and treat the stored tobacco. Voluminous warehouses are required to house the vast amounts of tobacco in storage.

Various attempts have been made to shorten the time necessary to convert freshly harvested tobacco into a smoking product which has desirable flavor and smoking qualities. For example, bacteria, enzymes, and other agents such as catalysts have been added to the tobacco in order to promote the chemical changes and accelerate the aging of the tobacco.

U.S. Pat. No: 3,256,888 discloses a process for treating tobacco. In the process, a proteolytic enzyme is added to a tobacco in an amount of 1.4 to about 2.8 grams of proteolytic enzyme per pound of tobacco.

Other processes have been developed for the flavor and aroma enhancement of tobacco and is smoke. Representative examples of such processes include the following U.S. Pat. Nos.: 187,924; 2,309,975; 3,256,889; 3,478015; 3,513,857; 3,920,026; 4,286,606; 4,306,577; and 4,537,204.

Consequently, a continuing need exists for improvements in methods for treating tobacco in respect of obtaining desirable end-use characteristics. In particular, a treating method which would reduce the time and treatment facilities otherwise required for the natural curing and aging process would be a significant advance in the art.

It is therefore an object of the present invention to provide an improved treatment which will accelerate the chemical processes which occur during conventional curing and aging, to produce a tobacco with high quality taste and flavor and reduced harshness.

SUMMARY OF THE INVENTION

The present invention includes a method for treating unaged tobacco to enhance its smoking quality. The present method produces a tobacco which has the desirable qualities of naturally-aged cured tobacco with out conventional long aging time requirements. The present method can be employed with existing tobacco processing equipment. The present invention also greatly reduces the movement and handling of tobacco prior to processing.

According to the method of the present invention, a tobacco is contacted with a monosacchride. The monosaccahride may suitably be employed in an aqueous solution for this purpose. Preferably, such monosaccharide solution is sprayed on on steamed tobacco. After the steamed tobacco has been thus treated and toasted, it is ready for processing. It is preferred that the aqueous solution be basic and include a latent amino acid source. Unaged tobacco treated according to the method of the present invention exhibits smoke and taste characteristics similar to those of naturally-aged, cured tobacco.

DETAILED DESCRIPTION OF THE INVENTION

Figure 1:
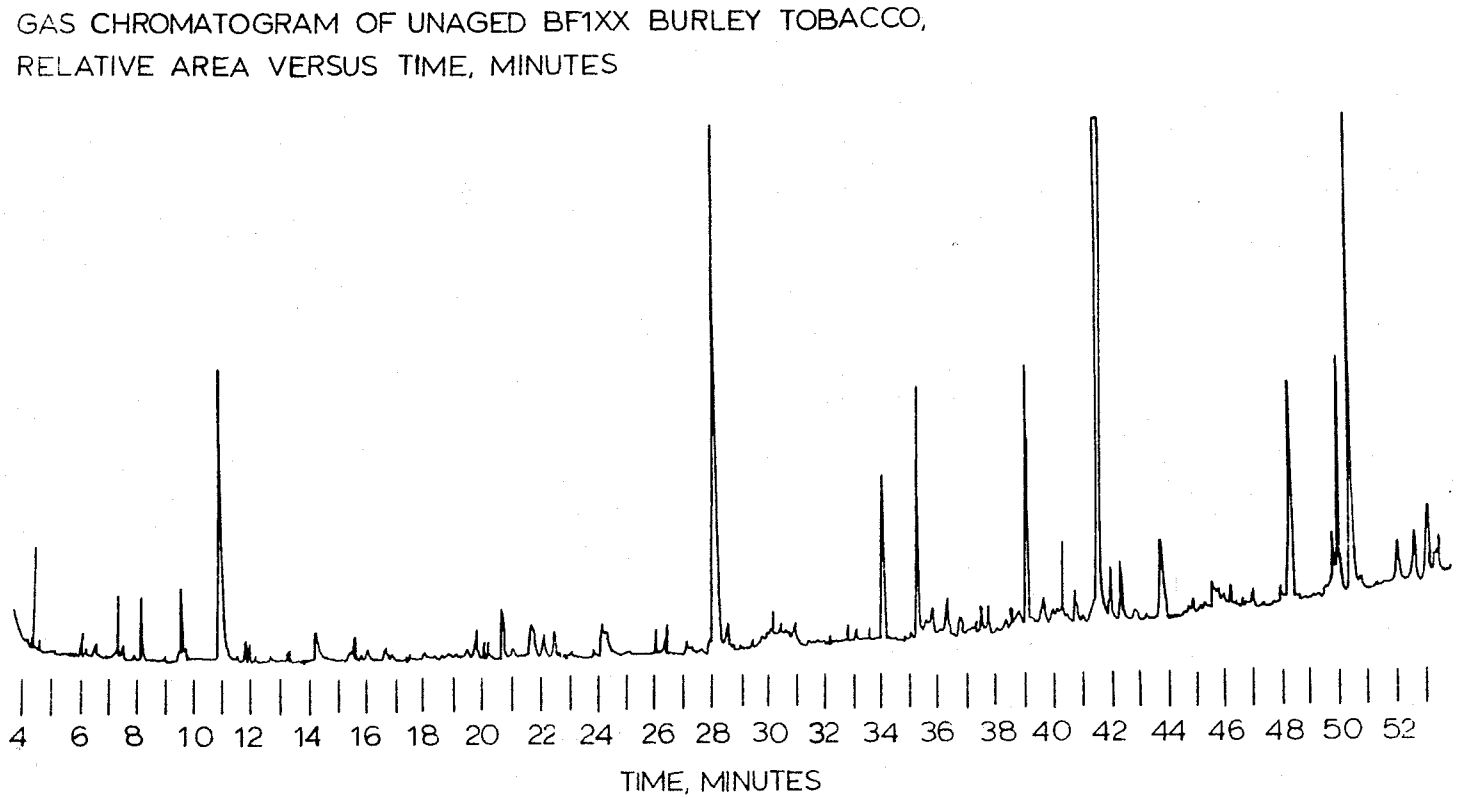
FIG. 1 is a gas chromatogram of a sample of unaged BF1XX burley tobacco, in which relative area is shown as a function of time, in minutes.

The present invention relates to a method for treating a cured, unaged tobacco, according to which an effective amount of a monosaccharide is contacted with the tobacco.

The monosaccharide can be applied to the tobacco in any suitable manner. It is generally suitable to apply the monosaccharide in the form of a liquid solution, suspension, or emulsion containing the monosaccharide, via spraying, dipping or other mode of application resulting in contacting of the monosaccharide with the tobacco.

The monosaccharide is preferably sprayed onto the tobacco in an aqueous "casing" solution with conventional tobacco casing equipment. Generally, a conveyor delivers the tobacco to a rotating casing cylinder or spray drum, in which the monosaccharide casing solution is sprayed onto the tobacco which is tumbling in the spray drum. The application rate is dependent upon the viscosity of the monosaccharide casing solution and the tobacco feed rate into the spray drum. A typical application rate is 0.22 lbs. casing solution per lb. of tobacco.

The conveyor then transports the sprayed tobacco to a toaster, in which the tobacco is toasted and prepared for processing into tobacco products. A typical toasting schedule includes ten minutes in a 300° F. compartment. The tobacco is cooled and ordered to approximately 14 percent moisture to prevent crumbling.

Preferably, the tobacco is steamed prior to or at the time the monosaccharide casing solution is sprayed onto the tobacco to insure homogeneous mixing and effective absorption.

The tobacco preferably is treated in full leaf form but can also be cut, sliced or otherwise comminuted before the treatment.

Most preferably, the monosaccharide casing solution can be applied to unaged tobacco at the stemmery. After the tobacco has been treated, the stems and lamina which thereafter are separated are immediately available for processing into cigarettes, cigars, pipe tobacco and other tobacco products.

In the practice of the present invention, the monosaccharides undergo a Maillard reaction with nitrogenous materials available in unaged tobacco, such as amino acids, hydrolyzed proteins including peptides and polypetides, nicotine, ammonia and amino compounds. Specifically, an initial reaction between monosaccharide sugars and alpha amino acids present in unaged tobacco results in aldosylaminos or ketosylaminos. These compounds undergo Amadori rearrangement involving dehydration and isomerization. The Amadori compounds degrade further with formation of furfurals. These reactions result in the formation of a large number of polymerized and heterocyclic compounds such as acetyls, furans, pyrroles, and aldols, all of which are aroma producing compounds.

Strecker degradation in early stages of the Maillard reaction produces flavorful aldehydes and ketones having one less carbon. Schiff bases are also formed from Strecker degradation which can undergo dehydration and dehydrogenation to form pyrazines which contribute significently to the odor and flavor of most roasted products.

The reaction products are formed by the Maillard, Strecker, Amadori and Schiff reactions, whereby the amino functional groups of the nitrogenous materials and the functional groups of the monosaccharide sugars react, and split off water by condensation. Further reactions take place such as cyclization of the nitrogenous material to the corresponding and substituted glycosylamine or heterocyclic compounds such as pyrazines, thiazoles, pyridines, furans, pyrroles and others. These reaction products are flavorants which enhance the flacor of tobacco.

The monosaccharide sugars which are generally useful in the practice of the invention may include fructose, glucose, galactose, mannose, xylose and mixtures thereof. Fructose and glucose are the preferred sugars.

It is preferred that the monosaccharide casing solution have a basic pH value. This enhances the Maillard reaction which in turn increases the aroma, taste and flavor notes and diminishes the harsh and irritating constituents produced in the tobacco smoke. It is therefore preferred that a base be added in sufficient amount to provide the present casing solution with a basic pH. Ammonia and ammonium phosphate and mixtures thereof are especially preferred basic compounds for this purpose. These added basic compounds as well as the naturally-occurring ammonia in tobacco enter into the Maillard reaction.

A dissociable latent amino acid source may desirably be added to the monosaccharide casing solution to serve as a catalyst or a triggering agent for the Maillard reaction. Hydrolyzed gelatin may be added to the casing solution for such purpose. The amino acids in the gelatin added will typically represent less than 10 percent of the amino acids naturally occurring in the tobacco. During the aging treatment of the invention, amino acids in the tobacco are reduced in the range of up to 25 percent. The vast majority of amino acids present in the hydrolized gelatin, such as alanine, glutamine, glycine, proline, hydroxyproline, glutamic acid, arginine, aspartic acid and others are naturally found in the tobacco. Other sources of hydrolyzed proteins can be substituted for the gelatin, including soy, casein, and partially hydrolyzed proteins such as peptides and polypeptides.

Another mode of the present invention includes adding a humectant to the monosaccharide casing solution. The humecatants were found to enhance the Maillard reaction. The humectants which are particularly useful include glycerine, propylene glycol, and mixtures thereof.

Diacetyl also is a Maillard reaction enhancer and may advantageously be employed in the casing solution to improve flavor and aroma characteristics of the treated tobacco.

The following three examples are illustrative of the present invention. The examples illustrate a monosaccharide casing solution for 1000 lbs. of burley tobacco. It is preferred that the casing solution be mixed in a non-corrosive kettle equipped with a stirrer and heater.

EXAMPLE 1

Into a 100 gallon mixing kettle, the following were combined with stirring: 17.1 gallons of water (142 lbs.) heated to 80° F., 5.0 lbs. of ammonium phosphate, 50 lbs. of Isomerose 80 (derived from corn syrup), 4.0 lbs. hydrolyzed gelatin, 20 lbs. glycerine, 10 lbs. propylene glycol and 1.50 lbs. diacetyl. The pH of the solution was adjusted to 8.0 with potassium hydroxide (KOH) and finally to 9.3–9.5 with gaseous ammonia ($NH_3$). The solution was stirred for a short period of time and then put through a spraying nozzle and sprayed into a rotary drum onto chopped or cut burley tobacco at the rate of about 0.22 lbs. of solution per pound of tobacco. The tobacco may be sprayed while on a tray at a thickness of approximately 1–6 inches, usually 3–6 inches.

EXAMPLE 2

Into a 100 gallon mixing kettle, the following were combined with stirring: 17.1 gallons of water (142 lbs.) heated to 80° F., 5.0 lbs. of ammonium phosphate, 50 lbs. of Isomerose 80 (derived from corn syrup), 4.0 lbs. hydrolyzed gelatin, 20 lbs. glycerine, 10 lbs. propylene glycol and 1.50 lbs. diacetyl. The pH of the solution was adjusted to 9.3–9.5 by bubbling gaseous ammonia beneath the surface while stirring. The solution was stirred for a short period of time and then put through a spraying nozzle and sprayed into a rotary drum onto chopped or cut burley tobacco at the rate of about 0.22 lbs. of solution per pound of tobacco. The tobacco may be sprayed while on a tray at a thickness of approximately 1–6 inches, usually 3–6 inches.

EXAMPLE 3

Into a 100 gallon mixing kettle, the following were combined with stirring: 17.1 gallons of water (142 lbs.) heated to 80° F., 5.0 lbs. of ammonium phosphate, 50 lbs. of Isomerose 80 (derived from corn syrup), 4.0 lbs. hydrolyzed gelatin, 20 lbs. glycerine, 10 lbs. propylene glycol and 1.50 lbs. diacetyl. The pH of the solution was adjusted to 9.5 with a potassium hydroxide solution, following which the solution was stirred for a short period of time and then put through a spraying nozzle and sprayed into a rotary drum onto chopped or cut burley tobacco at the rate of about 0.22 lbs. of solution per pound of tobacco. The tobacco may be sprayed while on a tray at a thickness of approximately 1–6 inches, usually 3–6 inches.

A preferred formulation of the casing solution prepared in accordance with the present invention is shown in Table I below:

TABLE I

MONOSACCHARIDE CASING SOLUTION FORMULATION

| Component | Preferred Concentration Wt. Percent of Casing Solution | Preferred Concentration Wt. Percent of Tobacco | Concentration Range Wt. Percent of Tobacco |
|---|---|---|---|
| Ammonium Phosphate | 2.13 | 0.50 | 0.1–5.0 |
| Hydrolyzed Gelatin | 1.70 | 0.40 | 0.1–2.0 |
| Fructose (Isomerase 80) | 21.30 | 5.00 | 0.5–20 |
| Glycerine | 8.52 | 2.00 | 2.0–12.0 |
| Propylene Glycol | 4.26 | 1.00 | 1.0–6.0 |
| Ammonia Gas | 1.00 (pH 9.5) | pH 9.5 | 7.0–10.5 |
| Diacetyl | 0.64 | 0.15 | .05–1.0 |
| Water | 60.50 | 14.20 | |
| pH | 9.5 | | 7–10.5 |

The average weight changes of various components of burely tobacco treated with the Table I casing solution are shown in Table II below based on eight separate runs, for which data is shown in Table IIA below:

TABLE IIA

CHEMICAL ANALYSIS OF BURLEY BEFORE AND AFTER ACCELERATED AGING, IN %

| | Run I | | Run II | | Run III | | Run IV | | Run V | | Run VI | | Run VII | | Run VIII | |
|---|---|---|---|---|---|---|---|---|---|---|---|---|---|---|---|---|
| | Before | After | Before | After | Before | After | Before | After | Before | After | Before | After | Before | After | Before | After |
| AMINO N | 0.67 | 0.56 | 0.62 | 0.49 | 0.59 | 0.45 | 0.73 | 0.56 | 0.73 | 0.49 | 0.56 | 0.48 | 0.62 | 0.38 | 0.45 | 0.36 |
| NICOTINE | 5.24 | 4.48 | 4.09 | 3.76 | 4.88 | 3.53 | 3.85 | 3.32 | 3.85 | 3.49 | 4.11 | 3.41 | 4.46 | 3.31 | 3.43 | 2.99 |
| PH | 5.57 | 5.46 | 5.58 | 5.24 | 5.52 | 5.21 | 5.95 | 6.25 | 5.95 | 5.20 | 6.11 | 5.52 | 6.16 | 5.54 | 6.51 | 5.72 |
| AMMONIA | 0.53 | 0.39 | 0.46 | 0.25 | 0.40 | 0.17 | 0.53 | 0.22 | 0.53 | 0.27 | 0.46 | 0.36 | 0.46 | 0.23 | 0.31 | 0.19 |
| WATER SOL. ACIDS | — | — | — | — | 5.56 | 5.22 | 3.53 | 4.33 | 3.53 | 4.98 | 3.24 | 4.02 | 2.90 | 3.98 | 2.30 | 3.42 |
| SUGAR | — | — | 2.20 | 0.30 | 2.50 | 0.20 | 2.80 | 0 | 3.20 | 0 | 2.6 | 0.30 | 3.87 | 0.11 | 2.19 | 0.32 |

TABLE II

AVERAGE CHANGES IN BURLEY TOBACCO COMPONENTS INCIDENT TO ACCELERATED AGING TREATMENT

| Component | Avg. Percent Change By Weight |
|---|---|
| Amino Acids | Reduced 25.0 |
| Nicotine | Reduced 15.0 |
| Ammonia | Reduced 45.0 |
| Sugars | Reduced 95.0 |
| Water Soluble Acids | Increased 25.0 |

The added amino acid represents 25% of the amino acid reduced by the present method. Thus, the added amino acid serves as a catalyst or a triggering mechanism for the reaction of the naturally occurring amino acids.

Water soluble acids which impart flavor and aroma to the smoke are substantially increased through the Maillard reaction. No externally supplied water soluble acids were added.

The reduction of the nicotine is due to its reaction in the Maillard reaction to form pyridines.

The pH is also reduced, largely in part due to loss of ammonia in the reaction.

Cigarettes made from treated burley tobacco were organoleptically tested by a laboratory taste panel. The tests showed that the cigarettes using the treated burley were at least equivalent to naturally-aged burley tobacco cigarettes. The test cigarettes were also found to have a flavor comparable to conventionally made cigarettes that contain the blend of aged burley and bright, and in most instances, the flavor and aroma notes in the smoke were substantially improved. Adjectives such as cocoa-like, chocolate, nutty, fruity were descriptions given by panel members.

Figure 2:
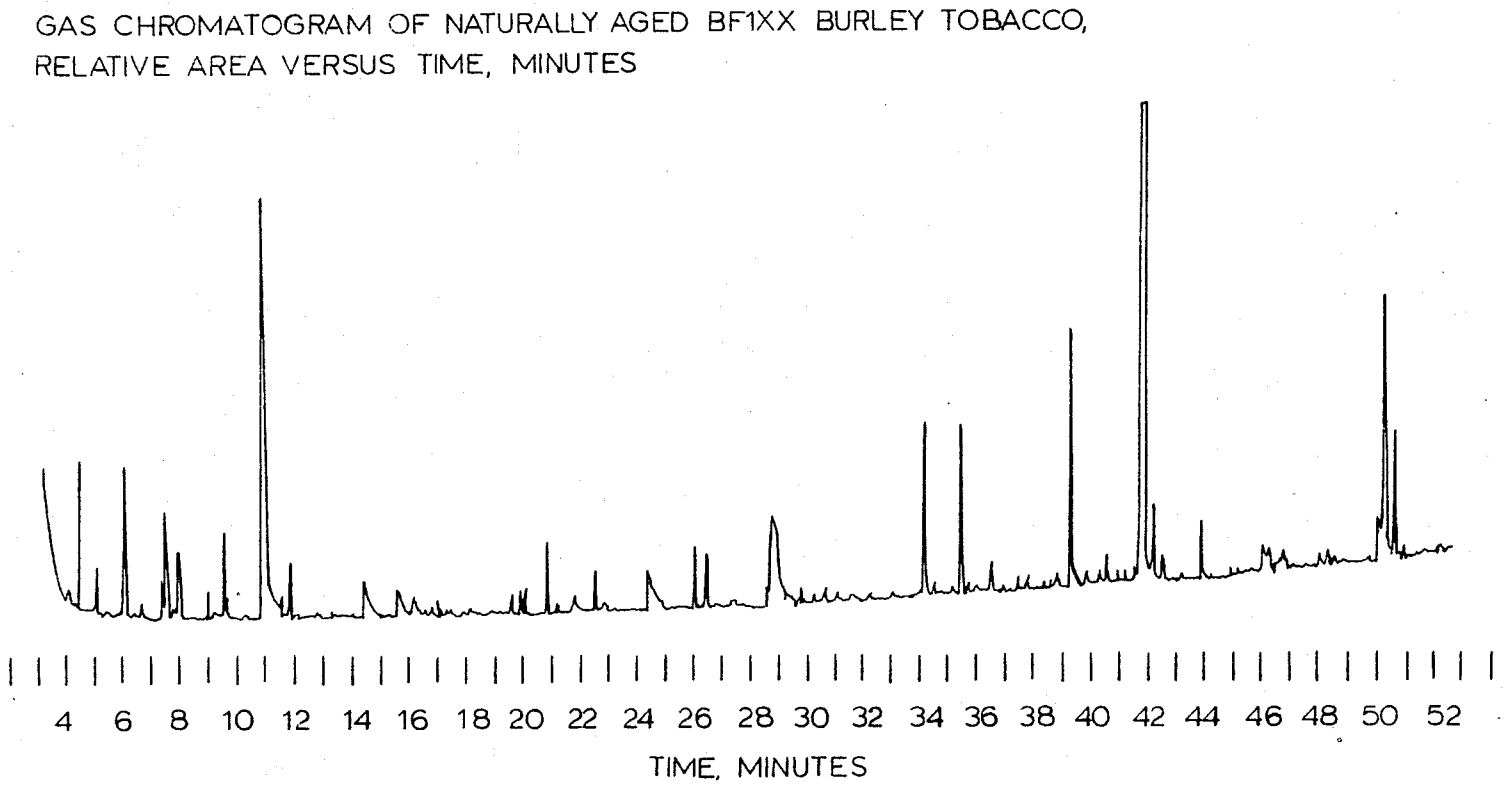
FIG. 2 is a gas chromatogram of a sample of naturally-aged BF1XX burley tobacco.
Figure 3:
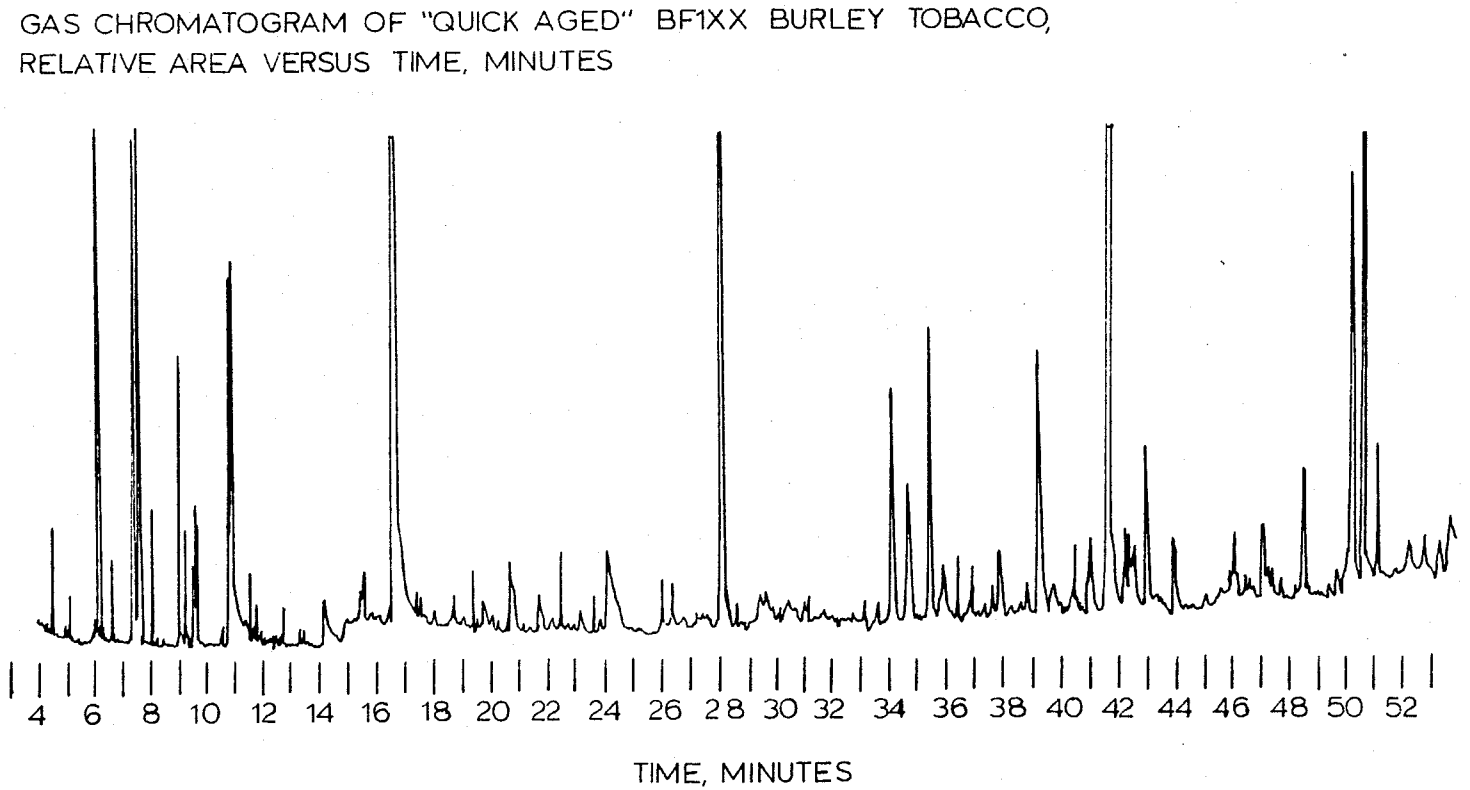
FIG. 3 is a gas chromatogram of a sample of previously unaged BF1XX burley tobacco treated ("quick aged") with a monosaccharide solution in accordance with the present invention.

Gas chromatograms for unaged burley tobacco, burley tobacco naturally-aged by conventional aging methods and burley tobacco treated by the casing solution according to present invention were recorded, utilizing a Carlo Erbe Strimentazione No. 4130 gas chromatograph with a fused silica column coated with WAX 57CB material, having a 50 meter length and an inner diameter of 0.25 mm programmed from 80° F. to 250° F., with an electrometer mode of 180. The chromatograms were illustrated in FIG. 1 (unaged burley), FIG. 2 (naturally-aged burley) and FIG. 3 (burley treated by the method of the invention, denoted "quick aged" burley tobacco) hereof. The corresponding data for these chromatograms, of relative area under the curves, recorded as a function of time, is presented in Tables III, IV, and V below, respectively.

Figure 4:
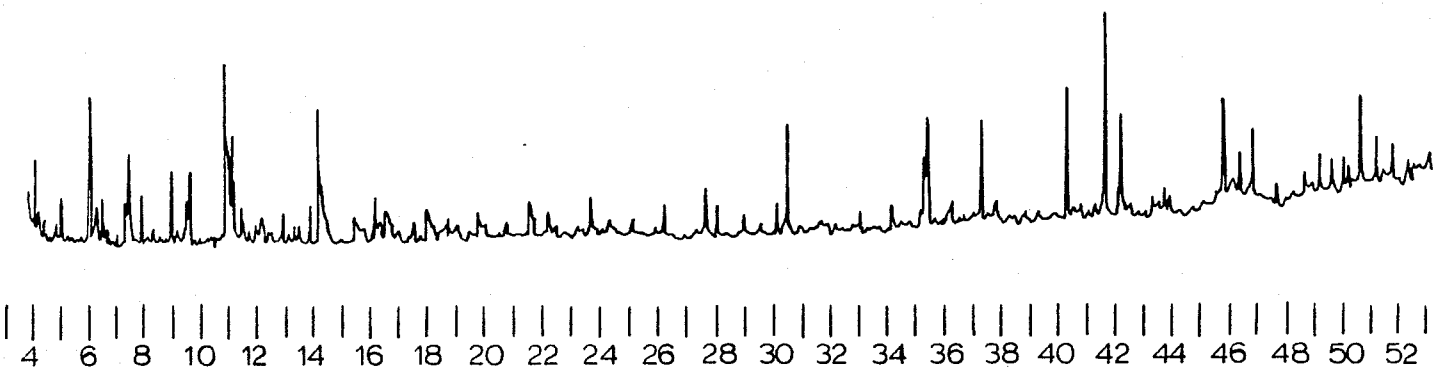
FIG. 4 is a gas chromatogram of smoke of the sample of FIG. 2.
Figure 5:
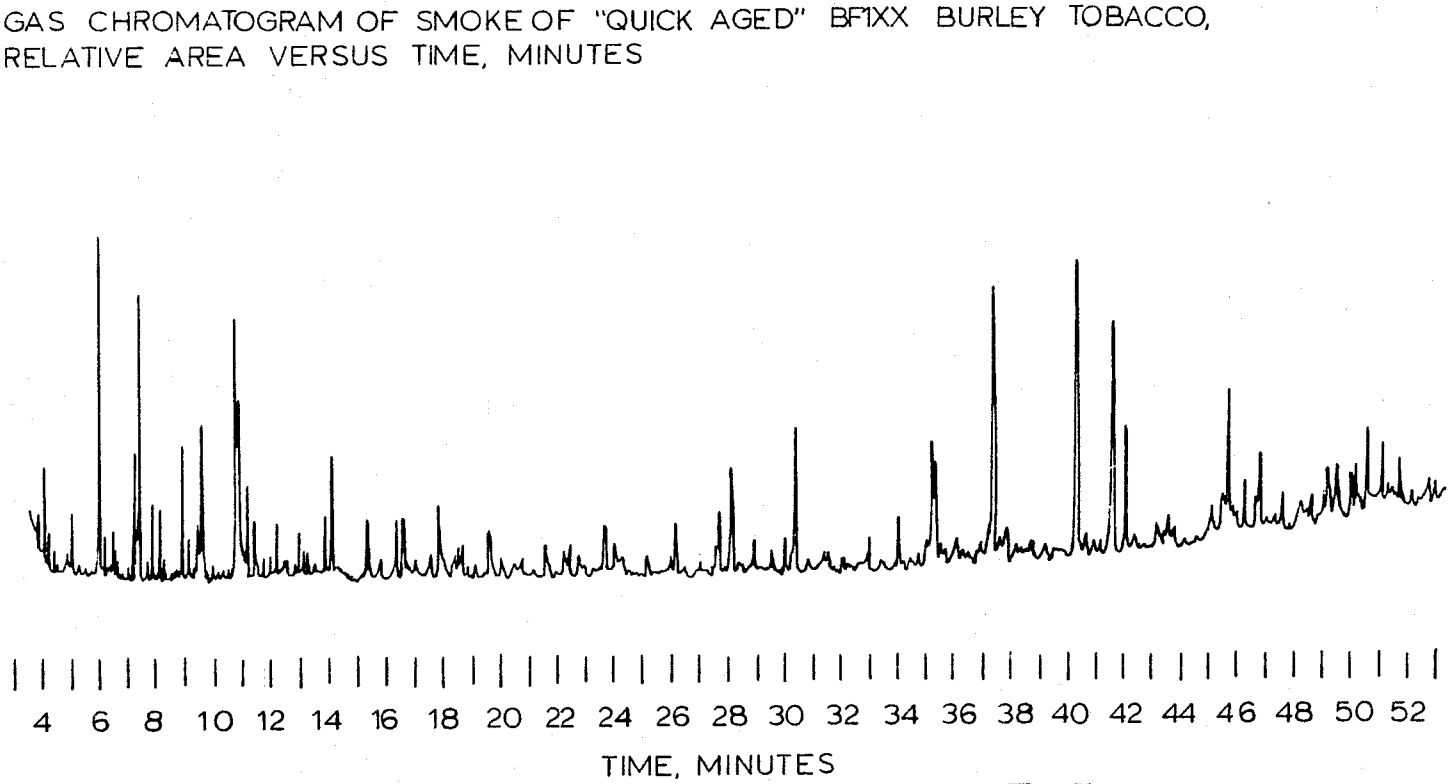
FIG. 5 is a gas chromatogram of smoke of the sample of FIG. 3.

Additionally, gas chromatograms of extracts of smoke from cigarettes made with such naturally-aged burley tobacco and the treated ("quick aged") burley tobacco were recorded as these are shown in FIGS. 4 (naturally-aged burley) and 5 (treated ("quick aged") burley) hereof. The corresponding data for these chromatograms, of relative area under the curves, recorded as a function of time, are presented in Tables VI and VII below, respectively.

Chromatograms for burley treated by the present invention show more peaks with significantly enchanced areas. Such treated burley contains a greater quantity and number of flavorants than naturally-aged burley tobaccos. Also the greater number of reaction products produced during the present method contribute to the improved aroma and flavor of tobacco as compared to naturally-aged tobacco.

Tables VIII and IX indicate the increased area of the chromatograms of the acceleratedly aged tobacco treated by the method of the invention, and smoke therefrom in the 4–20 minute range, where most of the flavorants such as pyrazines, thiazoles, pyridines, and their substituted counterparts show peaks in the chromatogram. The acceleratedly aged tobacco 4–20 minute fraction contains 13.8 percent of the total gas chromatogram as compared to 2.7 percent for unaged burley and 6.9 percent for the conventionally aged burley. The gas chromatograms of the smoke samples show the same type of results with the acceleratedly aged burley having 33.4 percent of the total chromatographic area as compared to 26.6 percent for the naturally-aged. The total gas chromatography areas for the acceleratedly aged tobacco sample and the smoke sample therefrom are much greater than the total areas of the respective unaged or naturally aged tobacco chromatograms.

Elevated temperatures in the process of the invention are preferably in the range of 180°–350° F. with retention time ranges from 5–20 minutes to about 48 to 72 hours depending on temperature. The greater the temperature, the shorter the heating period.

Because of the basic pH of the monosaccharide casing solution (between 9.3 and 9.5), it is desirable that all equipment utilized with the casing solution be constructed from a non-corrosive material.

While the present invention is particularly applicable to cured, unaged tobacco, it can be applied at any stage of conventional curing and aging processes with beneficial result. The treatment process of the invention also may advantageously be employed to upgrade low grade tobaccos susceptible to such treatment, e.g., low grade burley tobaccos, to improve their flavor, taste, and aroma characteristics.

Tobacco treated by the method of the invention may be utilized in cigarettes, cigars, pipes, and similar smoking articles in which tobacco is burned and the smoke therefrom inhaled, as well as in so-called "smokeless" cigarettes, cigars, etc., wherein a heat source produces warm air which is drawn through tobacco and/or tobacco extracts to form an inhalable vapor simulating the taste and aroma of burned tobacco.

Further, the invention has been described with particular reference to the aging of tobacco, it will be appreciated that the flavor enhancement of tobacco involves monosaccharide/amino acid reactions analogous to reactions which also occur in the ripening or aging of other plant products, e.g., peanuts, sweet potatoes, coffee, nuts, etc. It is therefore within the scope of the present invention to utilize contacting of monosaccharides with such plant products to enhance their flavor, taste, aroma, ripening, aging, etc.

Alternative embodiments, variations, and modifications of the present invention will be readily apparent to those skilled in the art in view of this disclosure, and accordingly all such embodiments, variations, and modifications are to be contemplated as being within the spirit and scope of the invention as disclosed herein.

TABLE III

GAS CHROMATOGRAPHIC DATA OF FIG. 1
UNAGED BF1XX BURLEY

| Minutes | Area | Minutes | Area |
|---|---|---|---|
| 4.6 | 1600 | 35.4 | 11031 |
| 6.2 | 499 | 35.7 | 481 |
| 7.5 | 1372 | 35.9 | 614 |
| 8.3 | 1588 | 36.4 | 1579 |
| 9.6 | 2221 | 36.9 | 837 |
| 10.9 | 18179 | 37.4 | 262 |
| 11.9 | 477 | 37.6 | 895 |
| 13.4 | 227 | 37.8 | 938 |
| 14.3 | 1942 | 38.5 | 425 |
| 15.6 | 1211 | 38.6 | 770 |
| 16.1 | 258 | 38.9 | 331 |
| 16.7 | 564 | 39.2 | 11748 |

TABLE III-continued

GAS CHROMATOGRAPHIC DATA OF FIG. 1
UNAGED BF1XX BURLEY

| Minutes | Area | Minutes | Area |
|---|---|---|---|
| 18.1 | 384 | 39.7 | 1655 |
| 19.6 | 321 | 40.1 | 856 |
| 19.8 | 1031 | 40.3 | 337 |
| 19.8 | 943 | 40.5 | 2788 |
| 20.1 | 364 | 40.9 | 1687 |
| 20.3 | 393 | 41.8 | 176477 |
| 20.8 | 1934 | 42.1 | 2010 |
| 21.2 | 309 | 42.5 | 3331 |
| 21.8 | 2607 | 42.9 | 406 |
| 22.2 | 1254 | 43.2 | 314 |
| 22.6 | 673 | 43.9 | 4830 |
| 23.9 | 219 | 44.9 | 365 |
| 24.2 | 1732 | 45.1 | 229 |
| 26.1 | 1194 | 45.5 | 933 |
| 26.5 | 959 | 45.7 | 2224 |
| 27.2 | 1108 | 46.4 | 787 |
| 28.1 | 42796 | 47.2 | 550 |
| 28.6 | 567 | 48.2 | 734 |
| 29.5 | 319 | 48.4 | 10110 |
| 30.0 | 557 | 49.6 | 431 |
| 30.1 | 843 | 49.8 | 347 |
| 30.2 | 346 | 50.0 | 1885 |
| 30.5 | 342 | 50.1 | 8829 |
| 31.0 | 483 | 50.5 | 26980 |
| 31.6 | 223 | 51.6 | 250 |
| 33.2 | 543 | 51.8 | 551 |
| 33.6 | 644 | 52.2 | 3284 |
| 34.1 | 6160 | 52.7 | 2316 |
| 35.1 | 202 | | |

TABLE IV

GAS CHROMATOGRAPHIC DATA OF FIG. 2
NATURALLY AGED BF1XX BURLEY

| Minutes | Area | Minutes | Area |
|---|---|---|---|
| 4.6 | 2441 | 31.1 | 245 |
| 5.3 | 882 | 34.2 | 6409 |
| 6.2 | 3924 | 35.2 | 215 |
| 6.8 | 321 | 35.4 | 7121 |
| 7.5 | 764 | 36.5 | 1193 |
| 7.7 | 2469 | 37.0 | 490 |
| 8.1 | 1667 | 37.5 | 286 |
| 9.2 | 645 | 37.9 | 634 |
| 9.7 | 2657 | 39.0 | 432 |
| 9.8 | 389 | 39.3 | 12800 |
| 11.0 | 31468 | 39.8 | 744 |
| 12.0 | 1529 | 40.4 | 407 |
| 14.5 | 3192 | 40.5 | 1496 |
| 15.7 | 1536 | 41.0 | 361 |
| 16.2 | 761 | 41.6 | 389 |
| 16.9 | 376 | 41.8 | 187346 |
| 17.0 | 288 | 42.2 | 2428 |
| 17.7 | 207 | 42.6 | 1180 |
| 18.3 | 393 | 43.3 | 228 |
| 19.7 | 537 | 44.0 | 2358 |
| 20.0 | 1926 | 45.2 | 256 |
| 20.2 | 521 | 46.2 | 2294 |
| 20.9 | 2957 | 46.9 | 515 |
| 21.9 | 1255 | 48.3 | 459 |
| 22.7 | 1524 | 48.4 | 282 |
| 23.0 | 586 | 48.8 | 317 |
| 24.5 | 4476 | 49.8 | 385 |
| 26.2 | 2205 | 50.1 | 2135 |
| 26.6 | 2039 | 50.2 | 12216 |
| 27.5 | 338 | 50.6 | 4597 |
| 28.7 | 555 | 51.0 | 315 |
| 28.9 | 13171 | 52.3 | 644 |
| 30.6 | 247 | 52.8 | 1233 |
| 30.6 | 345 | | |

TABLE V

GAS CHROMATOGRAPHIC DATA OF FIG. 3
"QUICK AGED" BF1XX BURLEY

| Minutes | Area | Minutes | Area | Minutes | Area |
|---|---|---|---|---|---|
| 4.4 | 226 | 20.1 | 221 | 38.9 | 1756 |
| 4.7 | 1558 | 20.8 | 3440 | 39.2 | 13176 |
| 5.3 | 777 | 21.5 | 218 | 39.8 | 1531 |
| 6.1 | 348 | 21.8 | 2805 | 40.4 | 1224 |
| 6.2 | 23858 | 22.2 | 849 | 40.5 | 2109 |
| 6.7 | 1990 | 22.6 | 3298 | 41.0 | 1272 |
| 7.5 | 11489 | 23.2 | 1227 | 41.0 | 4270 |
| 7.7 | 15629 | 23.8 | 1510 | 41.8 | 229372 |
| 7.7 | 3154 | 24.2 | 7226 | 42.1 | 3695 |
| 8.1 | 3327 | 26.1 | 3090 | 42.3 | 2819 |
| 9.1 | 7348 | 26.4 | 208 | 42.5 | 2806 |
| 9.3 | 2909 | 26.5 | 1348 | 42.9 | 7931 |
| 9.7 | 4330 | 26.8 | 281 | 43.3 | 301 |
| 9.8 | 3286 | 27.3 | 637 | 43.9 | 4503 |
| 10.6 | 805 | 28.1 | 53378 | 45.0 | 358 |
| 11.0 | 14906 | 28.7 | 802 | 45.1 | 676 |
| 11.1 | 18352 | 29.3 | 255 | 45.1 | 565 |
| 11.6 | 1491 | 29.5 | 2155 | 45.6 | 1934 |
| 11.9 | 852 | 29.7 | 319 | 45.9 | 1015 |
| 12.7 | 399 | 30.2 | 299 | 46.0 | 2449 |
| 12.8 | 1098 | 30.5 | 688 | 46.4 | 848 |
| 13.4 | 214 | 31.1 | 585 | 47.1 | 5749 |
| 13.6 | 357 | 31.2 | 410 | 47.4 | 644 |
| 14.4 | 3155 | 31.4 | 395 | 47.7 | 671 |
| 15.2 | 2251 | 32.8 | 297 | 48.2 | 448 |
| 15.6 | 1135 | 33.2 | 775 | 48.5 | 7075 |
| 15.7 | 1167 | 33.6 | 910 | 49.4 | 427 |
| 16.2 | 273 | 34.1 | 9960 | 49.6 | 1289 |
| 16.5 | 584 | 34.6 | 6957 | 50.0 | 3000 |
| 16.8 | 76277 | 35.4 | 13048 | 50.2 | 19509 |
| 17.5 | 411 | 35.9 | 4648 | 50.5 | 28730 |
| 17.6 | 450 | 36.4 | 2227 | 51.1 | 5648 |
| 18.1 | 803 | 36.9 | 1979 | 51.8 | 367 |
| 18.8 | 623 | 37.7 | 1040 | 52.2 | 2994 |
| 18.8 | 1270 | 37.9 | 3011 | 52.4 | 600 |
| 19.6 | 342 | 38.5 | 451 | 52.4 | 2051 |
| 19.8 | 2550 | 38.7 | 298 | | |

TABLE VI

GAS CHROMATOGRAPHIC DATA OF FIG. 4
NATURAL AGED (SMOKE)

| Minutes | Area | Minutes | Area | Minutes | Area |
|---|---|---|---|---|---|
| 4.3 | 1197 | 18.2 | 2090 | 37.3 | 6322 |
| 5.1 | 311 | 18.7 | 215 | 37.8 | 1055 |
| 5.3 | 715 | 18.8 | 346 | 38.3 | 530 |
| 6.2 | 273 | 19.6 | 232 | 38.8 | 287 |
| 6.2 | 2876 | 20.0 | 1769 | 39.2 | 576 |
| 6.4 | 893 | 20.9 | 440 | 40.2 | 5361 |
| 6.7 | 744 | 21.7 | 1633 | 40.7 | 312 |
| 7.5 | 997 | 22.4 | 1073 | 41.3 | 735 |
| 7.6 | 2244 | 22.6 | 235 | 41.5 | 753 |
| 7.7 | 547 | 23.0 | 670 | 41.6 | 8404 |
| 8.1 | 1302 | 23.6 | 1339 | 42.1 | 4717 |
| 8.4 | 224 | 23.8 | 1971 | 42.4 | 233 |
| 8.5 | 557 | 24.6 | 1395 | 43.2 | 814 |
| 9.1 | 1638 | 25.3 | 499 | 43.6 | 236 |
| 9.3 | 340 | 26.1 | 269 | 43.7 | 659 |
| 9.7 | 1727 | 26.3 | 1435 | 43.9 | 435 |
| 9.8 | 1552 | 27.5 | 394 | 44.7 | 347 |
| 10.2 | 226 | 27.8 | 2321 | 45.2 | 1204 |
| 10.9 | 297 | 28.2 | 1844 | 45.7 | 6249 |
| 11.0 | 10349 | 29.1 | 848 | 45.9 | 789 |
| 11.3 | 443 | 29.7 | 379 | 46.1 | 317 |
| 11.3 | 1246 | 30.2 | 1604 | 46.4 | 1300 |
| 11.6 | 770 | 30.4 | 396 | 46.7 | 407 |
| 11.9 | 660 | 30.5 | 4021 | 46.8 | 2010 |
| 12.2 | 573 | 31.0 | 371 | 47.6 | 622 |
| 12.3 | 768 | 31.6 | 200 | 48.4 | 964 |
| 12.6 | 319 | 31.7 | 239 | 48.7 | 1612 |
| 13.1 | 875 | 32.2 | 218 | 48.9 | 245 |
| 13.4 | 222 | 32.9 | 278 | 49.2 | 2148 |
| 13.5 | 457 | 32.9 | 255 | 49.6 | 1735 |
| 13.7 | 389 | 33.1 | 497 | 50.0 | 1807 |
| 14.1 | 1437 | 34.1 | 956 | 50.1 | 776 |
| 14.3 | 488 | 34.3 | 239 | 50.5 | 3316 |
| 14.4 | 4595 | 35.1 | 550 | 51.1 | 2256 |

TABLE VI-continued

GAS CHROMATOGRAPHIC DATA OF FIG. 4
NATURAL AGED (SMOKE)

| Minutes | Area | Minutes | Area | Minutes | Area |
|---|---|---|---|---|---|
| 15.7 | 1477 | 35.3 | 2740 | 51.4 | 259 |
| 16.4 | 1586 | 35.4 | 3997 | 51.7 | 1465 |
| 16.8 | 2130 | 36.2 | 1043 | 52.2 | 1516 |
| 17.6 | 885 | 37.0 | 266 | 52.5 | 432 |
| 18.0 | 232 | 37.0 | 547 | 53.0 | 704 |

TABLE VII

GAS CHROMATOGRAPHIC DATA OF FIG. 5
"QUICK AGED" (SMOKE)

| Minutes | Area | Minutes | Area | Minutes | Area |
|---|---|---|---|---|---|
| 4.2 | 1705 | 17.6 | 1484 | 36.2 | 1403 |
| 4.4 | 306 | 18.0 | 3838 | 36.9 | 255 |
| 4.6 | 213 | 18.5 | 1221 | 37.0 | 303 |
| 5.1 | 354 | 18.7 | 405 | 37.3 | 10381 |
| 5.2 | 1003 | 18.8 | 452 | 37.6 | 818 |
| 6.1 | 330 | 19.3 | 613 | 37.8 | 1178 |
| 6.2 | 7156 | 19.7 | 1324 | 38.3 | 1054 |
| 6.4 | 946 | 19.7 | 805 | 38.8 | 783 |
| 6.6 | 213 | 20.1 | 694 | 39.2 | 1521 |
| 6.7 | 839 | 20.7 | 568 | 39.6 | 324 |
| 6.8 | 235 | 20.9 | 362 | 40.2 | 10549 |
| 7.2 | 293 | 21.7 | 1655 | 40.7 | 525 |
| 7.5 | 3237 | 22.3 | 975 | 41.0 | 574 |
| 7.6 | 8022 | 22.4 | 229 | 41.3 | 539 |
| 7.9 | 352 | 22.6 | 665 | 41.5 | 1060 |
| 8.1 | 2275 | 22.9 | 1500 | 41.6 | 11077 |
| 8.3 | 1688 | 23.6 | 419 | 42.1 | 6393 |
| 8.5 | 589 | 23.8 | 2076 | 42.5 | 457 |
| 9.1 | 3489 | 24.1 | 1782 | 43.2 | 1149 |
| 9.3 | 942 | 25.3 | 721 | 43.6 | 429 |
| 9.5 | 306 | 26.1 | 367 | 43.7 | 1039 |
| 9.7 | 2173 | 26.3 | 1689 | 43.9 | 412 |
| 9.8 | 3693 | 27.1 | 402 | 44.4 | 688 |
| 10.2 | 399 | 27.8 | 4022 | 44.7 | 355 |
| 10.4 | 248 | 28.2 | 4278 | 45.1 | 3512 |
| 10.8 | 353 | 28.5 | 233 | 45.6 | 2186 |
| 10.9 | 9718 | 29.1 | 1015 | 45.7 | 6511 |
| 11.0 | 5226 | 29.7 | 783 | 45.9 | 211 |
| 11.3 | 2289 | 30.2 | 1651 | 46.4 | 2902 |
| 11.6 | 1870 | 30.4 | 620 | 46.7 | 921 |
| 11.9 | 752 | 30.5 | 4812 | 46.8 | 2529 |
| 12.2 | 1238 | 31.0 | 699 | 47.1 | 257 |
| 12.4 | 1295 | 31.5 | 750 | 47.6 | 1593 |
| 12.6 | 630 | 31.7 | 256 | 48.3 | 2699 |
| 13.1 | 1309 | 32.2 | 542 | 48.7 | 863 |
| 13.3 | 715 | 32.4 | 358 | 49.0 | 932 |
| 13.5 | 722 | 32.9 | 264 | 49.2 | 4423 |
| 13.8 | 395 | 33.1 | 753 | 49.6 | 2773 |
| 13.5 | 2153 | 33.6 | 457 | 50.0 | 1993 |
| 13.8 | 6009 | 34.1 | 2141 | 50.2 | 1727 |
| 14.1 | 219 | 34.3 | 279 | 50.5 | 5198 |
| 14.2 | 3078 | 34.6 | 265 | 51.1 | 2207 |
| 15.4 | 860 | 34.9 | 250 | 51.4 | 547 |
| 15.5 | 3078 | 35.1 | 867 | 51.7 | 1597 |
| 15.9 | 860 | 35.3 | 3963 | 52.2 | 915 |
| 16.5 | 2145 | 35.4 | 4233 | 52.7 | 1184 |
| 16.7 | 3957 | 35.6 | 306 | 53.0 | 813 |
| 17.1 | 322 | | | | |

TABLE VIII

THE EFFECT OF TREATMENT ON
TOBACCO BF1XX BURLEY

| TIME | UNAGED | | NATURAL AGED | | ACCELERATEDLY AGED | |
|---|---|---|---|---|---|---|
| MINUTES | AREA | % | AREA | % | AREA | % |
| 4.3–20 | 12,644 | 2.7 | 24,978 | 6.9 | 100,462 | 13.8 |
| 20–40 | 55,860 | 11.9 | 48,799 | 13.6 | 92,799 | 12.8 |
| 40–60 | 295,799 | 63.3 | 236,241 | 65.8 | 389,208 | 53.6 |
| 60–84.5 | 103,165 | 22.1 | 49,360 | 13.7 | 143,927 | 19.8 |
| | 467,488 | | 359,378 | | 726,396 | |

TABLE IX

| THE EFFECT OF TREATMENT ON SMOKE BF1XX BURLEY | | | | |
|---|---|---|---|---|
| TIME | UNAGED | | ACCELERATEDLY AGED | |
| MINUTES | AREA | % | AREA | % |
| 4.3–20 | 51,444 | 26.6 | 98,052 | 33.4 |
| 20–40 | 45,910 | 23.8 | 56,571 | 19.2 |
| 40–60 | 68,990 | 35.7 | 105,603 | 35.9 |
| 60–84.5 | 26,737 | 13.9 | 33,713 | 11.5 |
| | 193,081 | | 293,939 | |

What is claimed is:

1. A method of treating unaged tobacco, comprising contacting said tobacco with a monosaccharide substantially free from higher saccharides, for sufficient time and at sufficient temperature to at least partially react the monosaccharide with nitrogenous components of the tobacco.

2. A method according to claim 1, wherein said monosaccharide is in an aqueous solution contacted with said tobacco.

3. A method according to claim 2, comprising a dissociable latent amino acid source and/or dissociation products thereof in said aqueous soltuion.

4. The method according to claim 3, wherein said latent amino acid source is soy.

5. The method according to claim 3, wherein said amino acid source is casein.

6. The method according to claim 3, wherein said amino acid source is a peptide.

7. The method according to claim 3, wherein said amino acid source is a polypeptide.

8. A method according to claim 3, wherein said latent amino acid source is gelatin.

9. A method according to claim 2, wherein said aqueous solution contains a basic compound in sufficient amount to provide said solution with a basic pH.

10. A method according to claim 9, wherein said basic compound is selected from the group consisting of ammonia, ammonium phosphate, ammonium tartrates, ammonium acetates, calcium hydroxide, magnesium hydroxide, potassium hydroxide, sodium hydroxide, and mixtures thereof.

11. A method according to claim 2, wherein said aqueous solution comprises a humectant.

12. A method according to claim 11, wherein said humectant is selected from the group consisting of glycerine, propylene glycol, and mixtures thereof.

13. A method according to claim 2, wherein said contacting comprises spraying said aqueous solution onto said tobacco.

14. A method according to claim 2, wherein said contacting is carried out by spraying of said aqueous solution on said tobacco in the presence of steam, while the tobacco is retained in a rotating vessel.

15. A method according to claim 2, wherein the aqueous solution comprises diacetyl.

16. A method according to claim 1, wherein the aqueous solution comprises hydrolyzed gelatin.

17. A method according to claim 1, wherein said monosaccharide is selected from the group consisting of fructose, glucose, galactose, mannose, xylose, and mixtures thereof.

18. A method according to claim 1, wherein said tobacco comprises leaves and/or stems.

19. A method according to claim 1, wherein said contacting is conducted in the presence of steam.

20. A method according to claim 1, wherein said tobacco after said contacting is toasted at elevated temperature.

21. A method according to claim 20, wherein said toasting is effected by exposure of the tobacco to a temperature in the range of from about 180° to about 350° F. for a period of from about 5 minutes to 72 hours.

22. A method according to claim 20, wherein the tobacco is moisturized after said toasting.

23. A method according to claim 1, wherein said tobacco is a Burley tobacco.

24. A method according to claim 1, wherein said contacting is carried out for sufficient time and at sufficient temperature to reduce the amino acid content of said tobacco from that initially present in the tobacco prior to said contacting, by about 25% to about 60% by weight.

25. A method according to claim 1, wherein said contacting is carried out for sufficient time and at sufficient temperature to reduce the amino acid content of said tobacco from that initially present in the tobacco prior to said contacting, by about 30% to about 50% by weight.

26. A method according to claim 1, wherein said tobacco contains no more than about 2% by weight of sugars prior to said contacting.

27. A method according to claim 1, wherein said contacting is carried out for a period of from about 0.1 to about 24 hours.

28. A tobacco treated by the method of claim 27.

29. A tobacco treated by the method of claim 1.

30. A Burley tobacco produced by the method of claim 1.

31. A tobacco blend comprising a tobacco treated by the method of claim 1.

32. A cigarette, cigar, or similar smoking article, comprising a tobacco produced by the method of claim 1.

33. A method according to claim 1, wherein the treatment is carried out for sufficient time and at sufficient temperature to reduce the concentrations of the following components of the tobacco by the following amounts: amino acids by about 15% to about 40%; ammonia by about 20% to about 60%; and nicotine by about 5% to about 30%.

34. A method according to claim 1, wherein the monosaccharide is fructose.

35. A method of treating a cured and unaged tobacco to produce a tobacco having smoke and flavor qualities of a naturally-aged tobacco, comprising the step of contacting the tobacco with a monosaccharide substantially free from higher saccharides, for sufficient time and at sufficient temperature to at least partially react the monosaccharide with nitrogenous components of the tobacco and yield a tobacco of enhanced smoke and flavor qualities.

36. A tobacco casing solution for treating a cured and unaged tobacco, comprising an aqueous solution of (i) a monosaccharide substantially free from higher saccharides, (ii) a dissociable latent amino acid source and/or dissociation products thereof, and (iii) a basic compound in sufficient amount to provide said solution with a basic pH.

37. A tobacco casing solution according to claim 36, wherein the basic pH of said solution is from about 7.0 to about 10.5.

38. A tobacco casing solution according to claim 36, wherein the basic pH of said solution is from about 9.3 to about 9.5.

39. A method of treating tobacco which is susceptible to such treatment, to produce a tobacco having enhanced flavor qualities, comprising contacting the tobacco with a basic pH aqueous solution of a monosaccharide substantially free from higher saccharides, for sufficient time and at sufficent temperature to reduce the amino acid content of the tobacco by aout 25% to about 60% by weight of the amino acid content of the tobacco initially present therein prior to said contacting, and to substantially completely consume the monosaccharide.

40. A method according to claim 39, wherein the aqueous solution comprises a dissociable latent amino acid source and/or dissociation products thereof.

41. A method of treating a cured and unaged tobacco to produce a tobacco having enhanced flavor qualities, comprising contacting the tobacco with an aqueous solution comprising (i) a monosaccharide substantially free from higher saccharides, (ii) amino acids, and (iii) a basic compound in sufficient amount to provide the solution with a basic pH, for sufficient time and at sufficient temperature to yield tobacco of enhanced flavor qualities.

42. A method of treating a cured and unaged tobacco, by contacting the tobacco with a casing solution whose composition in weight percent, based on the weight of tobacco treated, consists essentially of:

| Component | Weight Percent Range |
|---|---|
| ammonium phosphate | 0.1–5.0 |
| hydrolyzed gelatin | 0.1–2.0 |
| fructose | 0.5–20 |
| glycerin | 2.0–12.0 |
| propylene glycol | 1.0–6.0 |
| ammonia gas | 7.0–10.5 |
| diacetyl | 0.05–1.0 |

wherein the aqueous solution has a pH of from 7 to 10.5.

* * * * *

UNITED STATES PATENT AND TRADEMARK OFFICE

CERTIFICATE OF CORRECTION

PATENT NO. : 4,827,949

DATED : May 9, 1989

INVENTOR(S) : Ernest C. Sunas

It is certified that error appears in the above-identified patent and that said Letters Patent is hereby corrected as shown below:

Column 1, line 15, change "is" to --it--.

Column 1, line 43, change "is" to --its--.

Column 2, line 7, delete second instance of "on".

Column 6, line 39, change "were" to --are--.

Column 11, line 25, change "soltuion" to --solution--.

Column 13, line 10, change "aout" to --about--.

Signed and Sealed this

Twenty-third Day of January, 1990

*Attest:*

JEFFREY M. SAMUELS

*Attesting Officer*

*Acting Commissioner of Patents and Trademarks*